United States Patent [19]

Takahashi

[11] Patent Number: 4,802,581

[45] Date of Patent: Feb. 7, 1989

[54] NEEDLE CASE

[75] Inventor: Masamitsu Takahashi, Hiroshima, Japan

[73] Assignee: Bankoku Needle Manufacturing Co., Ltd., Hiroshima, Japan

[21] Appl. No.: 167,842

[22] Filed: Mar. 14, 1988

[30] Foreign Application Priority Data

Apr. 24, 1987 [JP] Japan ..... 62-62154[U]
Jan. 16, 1988 [JP] Japan ..... 63-4000[U]

[51] Int. Cl.[4] ..... B65D 85/24

[52] U.S. Cl. ..... 206/380; 223/99; 223/109 R

[58] Field of Search ..... 206/380, 382, 383, 574; 223/99, 109 R

[56] References Cited

U.S. PATENT DOCUMENTS

| | | | |
|---|---|---|---|
| 234,514 | 11/1880 | Woodward | 206/380 |
| 4,167,231 | 9/1979 | Takahashi | 206/383 |
| 4,408,691 | 10/1983 | Takahashi | 206/382 |
| 4,573,575 | 3/1986 | Bergrath | 206/380 |

FOREIGN PATENT DOCUMENTS

| | | | |
|---|---|---|---|
| 0467455 | 8/1950 | Canada | 223/99 |
| 1191299 | 10/1959 | France | 223/99 |
| 0116205 | 6/1918 | United Kingdom | 206/380 |
| 0528419 | 10/1940 | United Kingdom | 223/99 |

*Primary Examiner*—Jimmy G. Foster
*Attorney, Agent, or Firm*—Wenderoth, Lind & Ponack

[57] ABSTRACT

A needle case includes a case member and a needle supporting member. The case member has an accommodation portion capable of accommodating therein a plurality of needles, a notch portion where any of the shanks of the needles can be pinched, a takeout opening from which a needle is extracted, and a cutaway portion through which thread is passed. The needle supporting member is formed of elastic metal or resin into a forked elongate member having a forked portion fixed to a portion of the case member at a position opposite to the position of the takeout opening, an extension portion extending in a direction in which a needle is extracted and passing through the eyes of the needles to support the needles in a suspended state within the accommodation portion, and an expansion portion disposed at a position corresponding to the position of the cutaway portion, having a hole of a diameter substantially the same as the width of the cutaway portion and large enough to easily pass thread therethrough, and capable of preventing the needles from passing therethrough due to an elastic force of the material thereof in an expanding direction thereof under normal conditions but permitting a needle to pass therethrough against the elastic force when a force for extracting the needle from the takeout opening is exerted on the needle.

2 Claims, 4 Drawing Sheets

NEEDLE CASE

BACKGROUND OF THE INVENTION AND RELATED ART STATEMENT

The present invention relates to a needle case for accommodating therein a plurality of needles and making it possible to automatically thread a needle the moment the needle is extracted from the needle case.

A conventional needle case as disclosed in U.S. Pat. No. 4,408,691, for example, has a pincushion member through which a plurality of needles are pierced, fixed to the inside thereof. In threading a needle retained in the conventional needle case, it is necessary to extract a needle from the needle case and then pass thread through the eye of the needle. Otherwise, it is necessary to open the needle case, thereby exposing the eyes of the needles pierced through the pincushion member to the outside of the needle case and, in that state, to pass thread through the eye of a needle and then extract the threaded needle from the needle case.

With the conventional needle case, as described above, an operation of extracting a needle from the needle case and an operation of threading the needle should be conducted separately and, what is worse, the threading operation is very cumbersome because the eye of the needle has a comparatively small diameter.

OBJECT AND SUMMARY OF THE INVENTION

The present invention has been accomplished in view of the aforementioned drawbacks.

The main object of the present invention is to provide a needle case for accommodating therein a plurality of needles and making it possible to facilitate a threading operation such that a needle is automatically threaded the moment the needle is extracted from the needle case.

To attain the object described above, according to the present invention, there is provided a needle case comprising a case member having an accommodation portion capable of accommodating a plurality of needles therein, a notch portion where any of the shanks of the needles can be pinched, a takeout opening from which a needle is extracted, and a cutaway portion through which thread is passed; and a needle supporting member formed of elastic metal or resin into a forked elongate member having a forked portion fixed to a portion of the case member at a position opposite to the position of the takeout opening of the case member, an extension portion extending in a direction in which a needle is extracted and passing through the eyes of the needles to support the needles in a suspended state within the accommodation portion of the case member, and an expansion portion disposed at a position corresponding to the position of the cutaway portion of the case member, having a hole of a diameter substantially the same as the width of the cutaway portion of the case member and large enough to easily pass thread therethrough, and capable of preventing the needles from passing therethrough due to an elastic force of the material thereof in an expanding direction under normal conditions but permitting a needle to pass therethrough against the elastic force when a force for extracting the needle from the takeout opening of the case member is exerted on the needle.

The above and other objects, characteristics features and advantages of the present invention will become more apparent to those skilled in the art as the disclosure is made in the following description of preferred embodiments of the invention, as illustrated in the accompanying drawings.

DETAILED DESCRIPTION OF THE PREFERRED EMBODIMENTS

The present invention will now be described in detail with reference to the illustrated embodiments.

Figure 2:
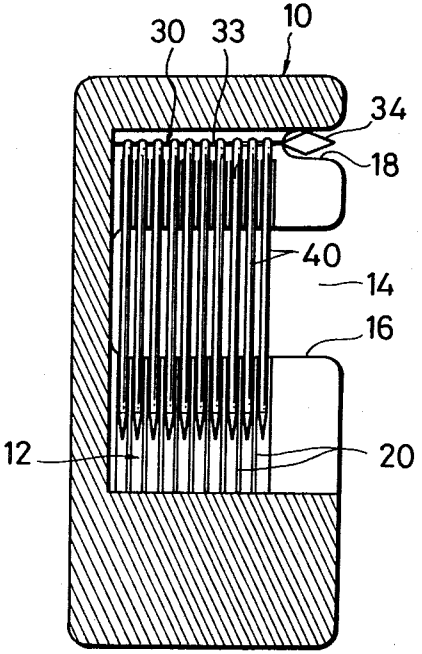
FIG. 2 is a longitudinal cross section illustrating the needle case of FIG. 1.
Figure 1:
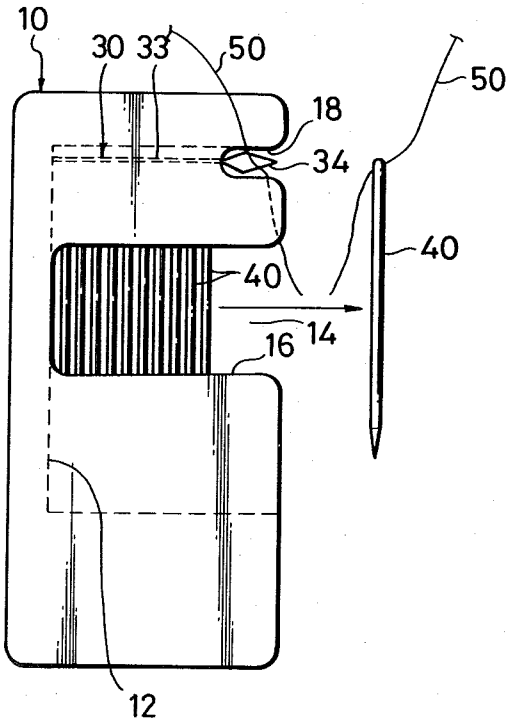
FIG. 1 is a schematic front view illustrating one embodiment of the needle case according to the present invention.

FIGS. 1 and 2 illustrate a first embodiment of the needle case acording to the present invention, which comprises a case member 10 of a comparatively flat and substantially rectangular shape and a needle supporting member 30 on which a plurality of needles 40 are to be retained in a suspended state.

The case member 10 is preferably made of a hard plastic material, has an accommodation portion 12 capable of accommodating therein a plurality of needles 40 in parallel, and is constructed such that the needles 40 accommodated within the accommodation portion 12 can be extracted in one direction one by one with the shank thereof pinched between the fingers. To be specific, the case member 10 also has a takeout opening 14 formed at one side thereof for extracting the needles 40 one by one therefrom, a notch portion 16 formed by cutting off a portion of the case member 10 at the accommodation portion 12 from the side of the takeout opening 14 so that any of the shanks of the needles 40 can be pinched by the fingers when the needles 40 have been accommodated within the accommodation portion 12, and a cutaway portion 18 formed by cutting off a portion of the case member 10 at a position above the notch portion 16 from the side of the takeout opening 14. Furthermore, as illustrated in FIG. 2, there are formed a plurality of ribs 20 on one or both inner walls of the case member 10 defining the accommodation portion 12. These ribs 20 are arranged at regular intervals and extend longitudinally so that each of the needles 40 is interposed between two adjacent ribs 20, thereby serving as means for preventing undesirable movement of the needles 40. In place of the ribs 20, there may be adopted spring means (not shown), such as a leaf spring, attached to one inner wall of the case member 10 defining the accommodation portion 12 and adapted to bias the needles 40 toward the other inner wall, as means for preventing undesirable movement of the needles 40.

The needle supporting member 30 is formed of elastic metal or resin into a forked elongate member having a forked portion, an extension portion 33 and an expansion portion 34. The forked portion is passed through the eyes of the needles so that the needles 40 are arranged in parallel and suspended from the extension portion 33 and is fixed at a position on the other side of the case member 10, i.e. on the side opposite the side of the takeout opening 14. The extension portion 33 extends integrally from the fixed forked portion in a direction of extracting the needles 40 from the takeout opening 14. The expansion portion 34 integral with the extension portion 33 is disposed at the cutaway portion 18 of the case member 10, has a hole of a diameter substantially the same as the width of the cutaway portion 18 and large enough to easily pass thread 50 therethrough, and is capable of preventing under normal conditions the needles 40 from passing therethrough due to an elastic force of the material of the needle supporting member 30 in an expanding direction thereof but is capable of permitting a needle 40 to pass therethrough against the elastic force when a force for extracting the needle 40 from the takeout opening 14 is exerted on the needle 40. In this embodiment, the expansion portion 34 is formed in a substantially rhombic shape. However, this is by no means limitative and any other shape may be adopted if the aforementioned preventing and permitting functions can be fulfilled and thread 50 can be easily passed through the hole of the expansion portion 34. It goes without saying that in this embodiment a needle 40 can be accommodated within the accommodation portion 12 from the side of the takeout opening 14 by applying the eye of the needle 40 to the corner of the rhombic expansion portion directed to the takeout opening 14 and forcibly pushing the needle 40 toward the accommodation portion 12.

With the construction of the needle case as described above, the needles 40 accommodated within the accommodation portion 12 of the case member 10, suspended vertically from the extension portion 33 of the needle supporting member 30 and prevented by the ribs 20 from undesirable movement can be extracted one by one from the takeout opening 14 by pinching the shank of the needle 40 exposed to the outside from the notch portion 16 between the fingers and pulling the same in the direction indicated by an arrow shown in FIG. 1.

In use of the needle case of this embodiment, thread 50 is passed through the hole of the rhombic expansion portion 34 of the needle supporting member 30 exposed to the outside from the cutaway portion 18 of the case member 10 as shown in FIG. 1 and, in this state, while holding the case member 10 with one hand the shank of the needle 40 disposed on the rightmost side in FIG. 1 is pinched between the fingers of the other hand and pulled out in the direction indicated by the arrow in FIG. 1. As a result, the rightmost needle 40 can be extracted from the takeout opening 14 of the case member 10, with the thread 50 passed through the eye of the needle 40 automatically in the course of the pulling operation.

According to the needle case of this embodiment, it is therefore possible to automatically thread a needle 40 accommodated in the needle case the moment the needle 40 is extracted from the needle case by merely passing thread 50 through the large-diameter hole of the expansion portion 34 of the needle supporting member 30 exposed to the outside from the cutaway portion 18 of the case member 10. Thus, the cumbersome operation of threading a needle which has heretofore been conducted independently can be eliminated.

Figure 3:
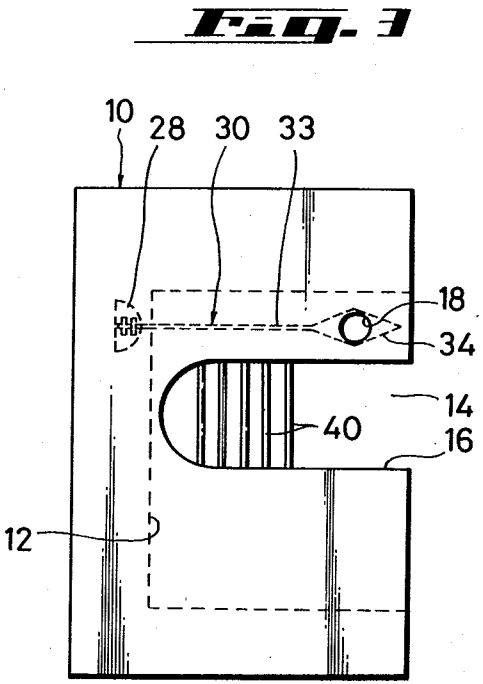
FIG. 3 is a schematic front view illustrating another embodiment of the needle case according to the present invention.
Figure 4:
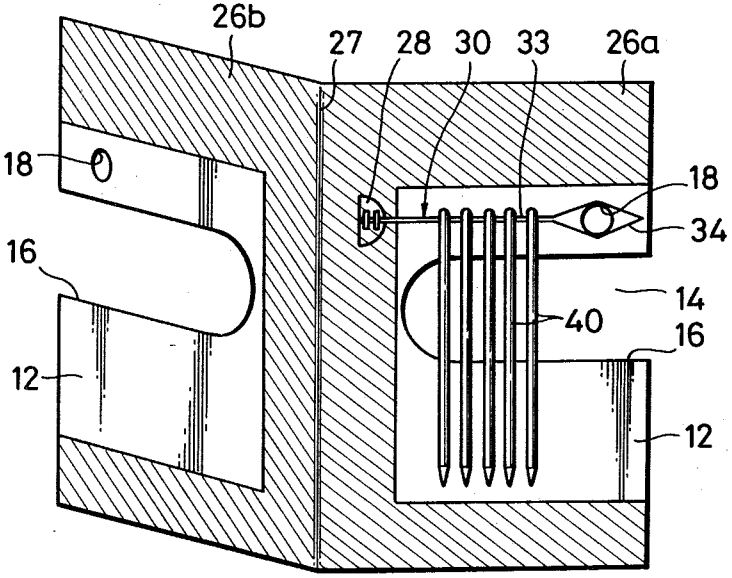
FIG. 4 is a front view illustrating the needle case of FIG. 3 is a developed state.

FIGS. 3 and 4 illustrate a second embodiment of the needle case according to the present invention. The same elements as those in the first embodiment are indicated by the same reference numerals as used in FIG. 1, and the description thereof is omitted in the following.

In the second embodiment, a case member 10 of the needle case is made of thick paper, thereby aiming at reduction of its manufacturing cost. The case member 10 comprises a pair of sheet portions **26*a* and 26*b* with a fold 27 as a boundary therebetween. Respective hatched portions of the sheet portions 26*a* and 26*b* shown in FIG. 4 are attached together and the remaining portions thereof serve as a needle accommodation portion 12 and define a needle takeout opening 14. In the first embodiment illustrated in FIGS. 1 and 2, the cutaway portion 18 of the case member 10 is formed by cutting off a portion of the case member 10 from the side of the takeout opening 14 at a position above the notch portion 16 and corresponding to the position of the hole of the expansion portion 34 of the needle supporting member 30. In the second embodiment, however, the cutaway portion 18 is formed into a circular through-hole to thereby further facilitate the determination of an object in a threading operation conducted relative to the hole of the expansion portion 34 of the needle supporting member 30. The forked portion, i.e. one end, of the needle supporting member 30 in the second embodiment is fastened to one sheet portion 26*a* by a fastener 28 and fixed thereto by attaching the two sheet portions 26*a* and 26*b*** to each other.

Figure 5:
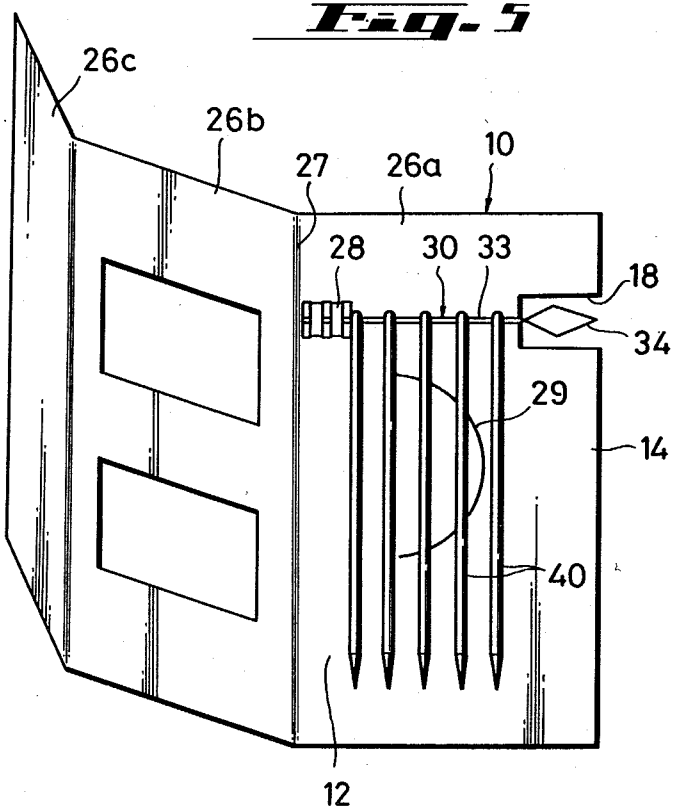
FIG. 5 is a schematic front view illustrating still another embodiment of the needle case according to the present invention in an open state.

FIG. 5 illustrates a third embodiment of the needle case according to the present invention. The same elements as those in the first and second embodiments are indicated by the same reference numerals as used in FIGS. 1 and 4, and the description thereof is omitted in the following.

In the third embodiment, a case member 10 of the needle case is made of thick paper similarly to that of the second embodiment shown in FIGS. 3 and 4, and comprise a pair of sheet portions **26*a* and 26*b* with a fold 27 as a boundary therebetween, a flap 26*c* joined integrally to the sheet portion 26*b*, and a flat holder 29 obtained by forming a semicircular cut in the sheet portion 26*a* at the center thereof. When the needle case is not used, the case member 10 is wrapped by superposing the sheet portion 26*b* on the sheet portion 26*a* and inserting the flap 26*c* under the flap holder 29. In use, the case member 10 is unwrapped as shown in FIG. 5**.

Figure 7:
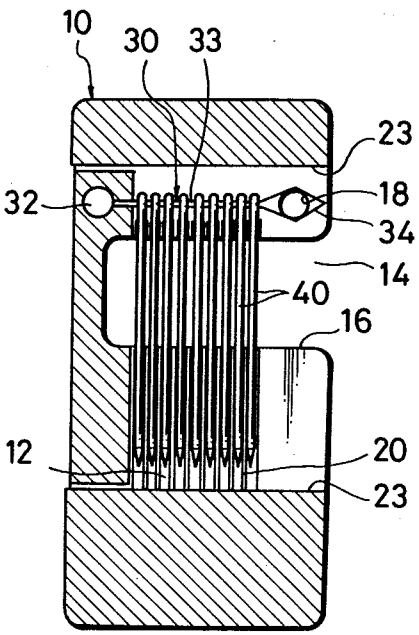
FIG. 7 is a longitudinal cross section illustrating the needle case of FIG. 6, with a lid member detached.
Figure 6:
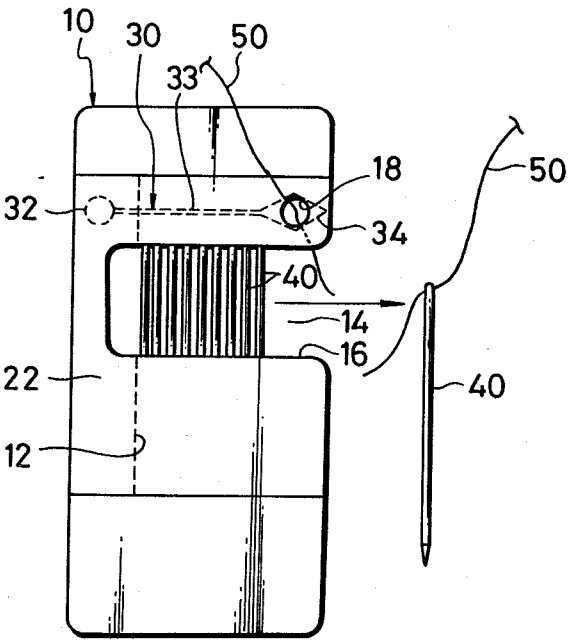
FIG. 6 is a schematic front view illustrating yet another embodiment of the needle case according to the present invention.

FIGS. 6 to 8 illustrate a fourth embodiment of the needle case according to the present invention. The same elements as those in the first and second embodiments are indicated by the same reference numerals as used in FIGS. 1 and 4, and the description thereof is omitted in the following.

In the fourth embodiment, a case member 10 is made of a hard plastic material similarly to that of the first embodiment shown in FIGS. 1 and 2, and a needle supporting member 30 is detachably mounted on the case member 10 so that it can be replaced by another one. To be specific, one of opposed plastic sheets of the case member 10 defining the accommodation portion 12 is separated from the case member to serve as a lid member 22. A lid member 22 has upper and lower sides 22*a* and 22*b* (FIG. 8B) which are detachably fitted in upper and lower engaging grooves 23 (FIG. 8A) formed on the side of the other plastic sheet by separating the lid member 22 from the case member 10. The other plastic sheet of the case member 10 is provided on the side opposite the side of the takeout opening 14 with a stopper portion 24 (FIG. 8A) which is a circular concave in this embodiment. On the other hand, the needle supporting member 30 has its forked portion provided integrally with a fitting plastic member 32 (FIG. 8C) which is a thin solid cylinder in this embodiment. The fitting member 32 of the needle supporting member 30 is detachably fitted in the stopper portion 24 of the case member 10.

Figure 9B:
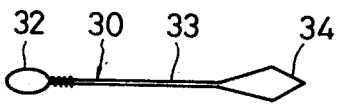
FIG. 9B is a front view illustrating another modification of the needle supporting member.
Figure 9A:
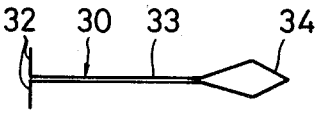
FIG. 9A is a front view illustrating a modification of the needle supporting member.

The shape of the fitting member 32 may be a cube (not shown), for example. In this case, however, the stopper portion 24 of the case member 10 is formed into a square concave capable of snugly admitting the cubic fitting member. Optionally, as shown in FIG. 9A, the forks of the forked portion of the needle supporting member 30 are bent at right angles so as to be away from each other, thereby serving as the fitting member 32. Also in this case, the stopper portion 24 of the case member 10 is formed so that it can snugly admit the bent fitting member 32. Furthermore, the fitting member 32 may be formed in the shape of a ring as shown in FIG. 9B by looping one of the forks of the forked portion and fastening it to the other fork. In this case, the stopper potion 24 of the case member 10 is formed into a short projection so that the ring-shaped fitting member can be hooked about the short projection. Thus, any other modification can be adopted insofar as the fitting member 32 and the stopper portion 24 can be engaged with each other.

Figure 8C:
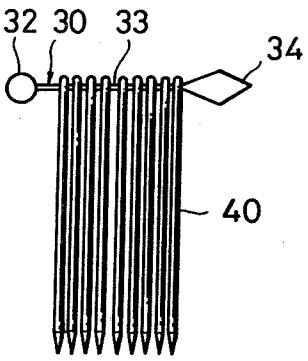
FIG. 8C is a front view illustrating a needle supporting member of the needle case of FIG. 6, with needles supported thereon in a suspended state.
Figure 8B:
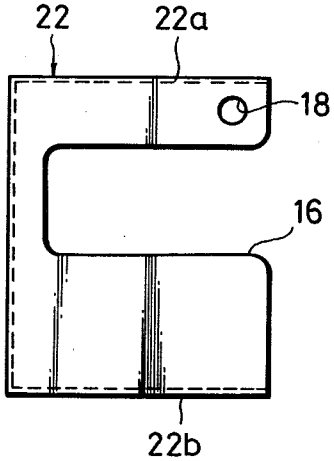
FIG. 8B is a front view illustrating the lid member of the needle case of FIG. 6.
Figure 8A:
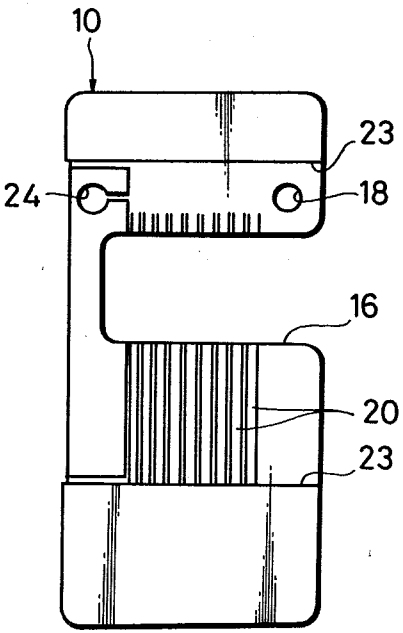
FIG. 8A is a front view illustrating a case member of the needle case of FIG. 6.

Returning to the fourth embodiment shown in FIGS. 6 to 8, the needle supporting member 30 is easily replaced with a new one which supports a plurality of needles 40 thereon in a suspended state as shown in FIG. 8C by detaching the lid member 22 from the case member 10, then detaching the fitting member 32 from the stopper portion 24, subsequently attaching the new needle supporting member 30 to the case member 10 with the fitting member 32 thereof engaged with the stopper portion 24, and finally attaching the detached lid member 22 to the case member.

According to the present invention, as described above, it is possible to automatically thread a needle accommodated in the needle case the moment the needle is extracted from the needle case by merely passing thread through the hole of the expansion portion of the needle supporting member exposed to the outside from the cutaway portion of the case member. Thus, the cumbersome operation of threading a needle which has heretofore been conducted independently can be eliminated.

What is claimed is:

1. A needle case comprising:

a case member having an accommodation portion capable of accommodating a plurality of needles therein, a notch portion where any of the shanks of the needles can be pinched, a takeout opening from which a needle is extracted, and a cutaway portion through which thread is passed; and a needle supporting member formed of elastic metal or resin into a forked elongate member having a forked portion fixed to a portion of said case member at a position opposite to the position of said takeout opening of said case member, an extension portion extending in a direction in which a needle is extracted and passing through the eyes of the needles to support the needles in a suspended state within said accommodation of said case member, and an expansion portion disposed at a position corresponding to the position of said cutaway portion of said case member, having a hole of a diameter substantially the same as the width of said cutaway portion of said case member and large enough to easily pass thread therethrough, and capable of preventing the needles from passing therethrough due to an elastic force of the material thereof in an expanding direction thereof under normal conditions but permitting a needle to pass therethrough against the elastic force when a force for extracting the needle from said takeout opening of said case member is exerted on the needle.

2. The needle case according to claim 1, wherein said case member has part thereof separated therefrom so that said part serves as a lid member for said case member, said lid member being detachably fitted relative to said case member, said case member further having a stopper portion at the side thereof opposite the side of said takeout opening, and wherein said needle supporting member is further provided with a fitting member which is integral with said forked portion and detachably engageable with said stopper portion of said case member, whereby said needle supporting member is replaced with a new one.

* * * * *